US006328422B1

(12) United States Patent
Watanabe et al.

(10) Patent No.: US 6,328,422 B1
(45) **Date of Patent: *Dec. 11, 2001**

(54) INK JET HEAD CARTRIDGE HAVING A FOLDED WIRING MEMBER

(75) Inventors: Kenjiro Watanabe, Tokyo; Kouji Yamakawa, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/992,508

(22) Filed: Dec. 17, 1992

(30) Foreign Application Priority Data

| | | |
|---|---|---|
| Dec. 19, 1991 | (JP) | 3-336930 |
| Dec. 19, 1991 | (JP) | 3-336947 |
| Jun. 30, 1992 | (JP) | 4-173260 |

(51) Int. Cl.[7] ..... B41J 2/14
(52) U.S. Cl. ..... 347/50
(58) Field of Search ..... 346/140 R, 139 C; 347/50, 49, 197, 198, 208, 209, 20, 54, 56, 63, 65, 85, 86, 87; B41J 2/175

(56) References Cited

U.S. PATENT DOCUMENTS

| | | | | |
|---|---|---|---|---|
| 4,095,237 | * | 6/1978 | Amberntsson et al. | 346/140 R |
| 4,306,245 | * | 12/1981 | Kasugayama et al. | 346/140 R |
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,555,715 | * | 11/1985 | Vegeais et al. | 347/200 |
| 4,558,333 | | 12/1985 | Suqitani et al. | 346/140 R |
| 4,586,056 | | 4/1986 | Okamura et al. | 346/139 C |
| 4,608,577 | | 8/1986 | Hori | |
| 4,630,078 | | 12/1986 | Watanabe | 346/140 R |
| 4,634,195 | | 1/1987 | Shoemaker | 339/17 F |
| 4,635,080 | | 1/1987 | Watanabe | 346/140 R |
| 4,723,129 | | 2/1988 | Endo et al. | 346/1.1 |
| 4,740,796 | | 4/1988 | Endo et al. | 346/1.1 |
| 4,872,027 | | 10/1989 | Buskirk et al. | |
| 4,914,562 | | 4/1990 | Abe et al. | |
| 4,922,269 | * | 5/1990 | Ikeda et al. | 346/140 R |
| 5,182,580 | | 1/1993 | Ikeda et al. | |
| 5,512,926 | | 4/1996 | Uchikata et al. | 347/86 |
| 5,652,608 | * | 7/1997 | Watanabe et al. | 347/50 |

FOREIGN PATENT DOCUMENTS

| | | | |
|---|---|---|---|
| 0 286 258 | 10/1988 | (EP) | |
| 0418817 | 3/1991 | (EP) | |
| 0459481 | 12/1991 | (EP) | |
| 0498400 | 8/1992 | (EP) | |
| 0546544 | 6/1993 | (EP) | |
| 0547596 | 6/1993 | (EP) | |
| 54-56847 | 5/1979 | (JP) | |
| 59-123670 | 7/1984 | (JP) | |
| 59-138461 | 8/1984 | (JP) | |
| 60-71260 | 4/1985 | (JP) | |
| 60-242073 | 12/1985 | (JP) | |
| WO91004861 | 4/1991 | (WO) | B41J/2/175 |

* cited by examiner

*Primary Examiner*—Benjamin R. Fuller
*Assistant Examiner*—C. Dickens
(74) *Attorney, Agent, or Firm*—Fitzpatrick, Cella, Harper & Scinto

(57) ABSTRACT

An ink jet recording head for ejecting ink through an ejection outlet for effecting record includes a supporting member; a recording element having an energy generating element for applying energy to the ink to eject it in accordance with a record signal; a wiring member including electric connection part relative to the recording element and a second electric connection part relative to an outside of the recording head to transmit the record signal to the recording element; wherein the first electric connection part is disposed on one face of the supporting member, the second electric connection part is disposed on another surface of the supporting member.

18 Claims, 9 Drawing Sheets

INK JET HEAD CARTRIDGE HAVING A FOLDED WIRING MEMBER

FIELD OF THE INVENTION AND RELATED ART

The present invention relates to a small size ink jet recording head and an ink jet recording head cartridge which are detachably mountable to a recording apparatus, and to a recording apparatus using the same.

Recently, various recording systems have been developed. Among them, an ink jet recording system in which ink is ejected through an ejection outlet in accordance with record signal, is widely used because of the advantages of its small size and the low noise.

The recording head used in such an ink jet recording apparatus is in the form of a detachably mountable recording head cartridge from the standpoint of easy maintenance and service life or the like.

The recording head cartridge detachably mountable to the recording apparatus and the recording apparatus are electrically connected by electric connection contacts (connectors) for transmitting signals for driving the recording head from the recording apparatus. When the recording head is mounted on the recording apparatus, the contacts are electrically connected.

However, in the case of a detachably mountable recording head cartridge, there is a possibility that the ink leaking through the ejection outlet contaminates the contacts with the result that there is inadequate electric connection.

In order to solve this problem, U.S. Pat. No. 4,635,080 discloses that the contacts are disposed on a surface which is different from an ejection side surface having the ejection outlets of a recording head cartridge having an integral ink container.

The recent demand for the small size of the recording apparatus, requires reduction of the size of the recording head cartridge. In this case, the ink capacity of an ink container constituting the recording head cartridge also decreases. In addition, the difference of the service life from that of the recording head constituting the head cartridge. Therefore, from the standpoint of cost and from the standpoint of re-use of the recording head, a recording head cartridge in which the ink container and the recording head are separable, is considered.

The ink is supplied from the ink container to the recording head through an ink supply port. In addition, the driving signal is supplied by the electric connection between the electric contacts of the recording head and the recording apparatus.

FIGS. 14 and 15 shows an example of an ink jet recording head not using the present invention. The ink jet recording head is of a type in which electrothermal transducers are used as energy generating means, and the ink droplets are ejected by bubble creation in the ink by the thermal energy produced by the electrothermal transducers. These figures show a recording head which is connectable to and separable from an ink container. A supporting plate 1 has a top surface to which energy base plate and wiring base plate 9 are bonded. The energy base plate (heater board) is mainly made of Si or the like having on a surface thereof a heat generating portion (heaters) of electrothermal transducers effective to generate thermal energy. The base plate 9 (wiring board) is made mainly of glass or epoxy resin material and effective to transmit the electric signals from the main assembly of the recording apparatus to the heater board 2. The heater board 2 and the wiring board 9 are electrically connected by wire bonding 7.

The top surface of the wiring board 9 is provided with contact pads (electric contacts) 4 electrically connected with a flexible wiring board of the main assembly of the recording apparatus.

The ink is supplied from an ink container or recording apparatus side through an ink supply member 6 to a common liquid chamber and ejection nozzles constituted by the bonding between the heater board 2 and a top plate 5, and the ink is ejected through the ejection outlets 8.

However, in such a recording head, ink passes through a joint between an ink supply member 6 and an ink container or an ink supplying portion of the apparatus, and a portion having the contact pads 4 of the wiring board 9, are disposed on the same side of the supporting plate 1. Therefore, when the recording head is connected or disengaged, the ink leaking from the joint may contact the contact pads with the result that there is inadequate or improper electric connection.

Recently, the further reduction of the size is desired. Since the number of pads and the area of each of the pads are more or less limited, and therefore, it is difficult to further reduce the area occupied by the contact pads. In addition, the area of the recording head supporting plate is determined by the areas of the heater board portion, the wire bonding portion and the contact pad portion. For these reasons, the reduction of the size of the head is not easy.

SUMMARY OF THE INVENTION

Accordingly, it is a principal object of the present invention to provide an ink jet recording head, an ink jet recording head cartridge and a recording apparatus using the same in which the reliable and stable ink ejection is possible in a small size apparatus.

According to an aspect of the present invention, there is provided an ink jet recording head for ejecting ink through an ejection outlet for effecting recording, comprising: a supporting member; a recording element having an energy generating means for applying energy to the ink to eject it in accordance with a record signal; a wiring member including electric connection part relative to the recording element and a second electric connection part relative to an outside of the recording head to transmit the record signal to the recording element; wherein the first electric connection part is disposed on one face of the supporting member, the second electric connection part is disposed on another surface of the supporting member.

According to another aspect of the present invention, there is provided an ink jet recording head cartridge, comprising: an ink jet recording head for ejecting ink through an ejection outlet for effecting record, including: a supporting member; a recording element having an energy generating means for applying energy to the ink to eject it in accordance with a record signal; a wiring member including electric connection part relative to the recording element and a second electric connection part relative to an outside of the recording head to transmit the record signal to the recording element; wherein the first electric connection part is disposed on one face of the supporting member, the second electric connection part is disposed on another surface of the supporting member; said ink jet recording head cartridge further comprises an ink container connected with the ink jet recording head to supply the ink to the recording head.

According to a further aspect of the present: invention, there is provided an ink jet recording apparatus, comprising: an ink jet recording head for ejecting ink through an ejection outlet for effecting record, including: a supporting member;

a recording element having an energy generating means for applying energy to the ink to eject it in accordance with a record signal; a wiring member including electric connection part relative to the recording element and a second electric connection part relative to an outside of the recording head to transmit the record signal to the recording element; wherein the first electric connection part is disposed on one face of said supporting member, the second electric connection part is disposed on another surface of the supporting member; wherein the recording apparatus further comprises electric connection contactable with the second electric connection part.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
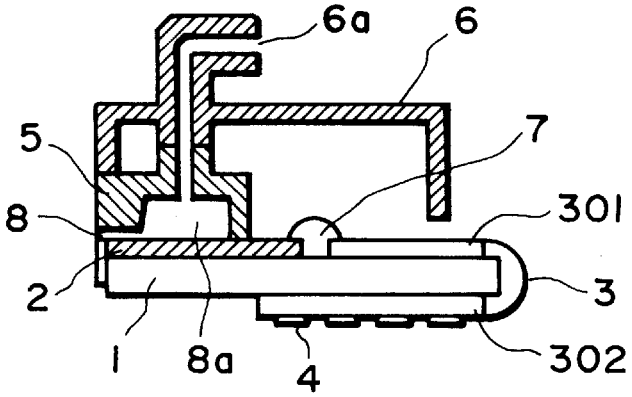
FIG. 1 is a sectional view of an ink jet recording head according to an embodiment of the present invention.
Figure 3A:
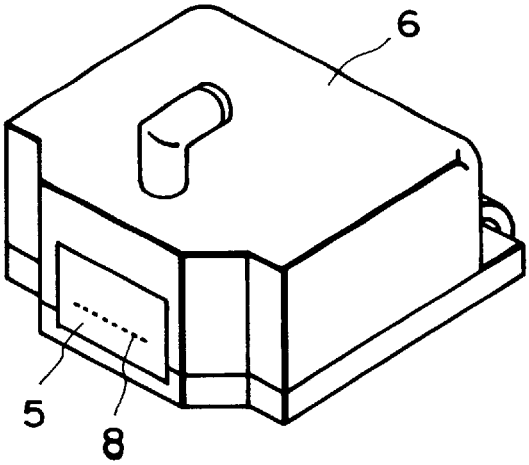
FIGS. 3A and 3B are top and bottom perspective views of the ink jet recording head.
Figure 3B:
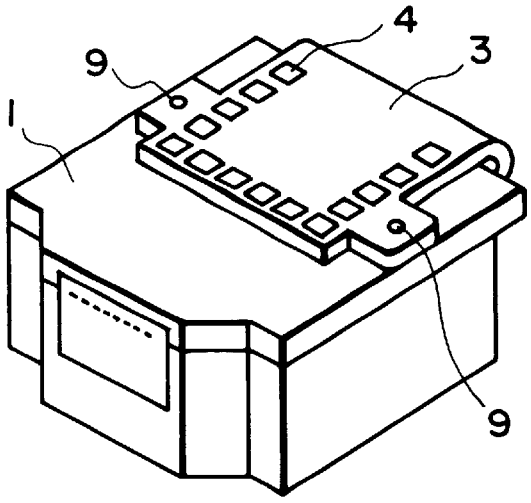

Referring to FIGS. 1, 3A and 3B, an ink jet recording head according to an embodiment of the present invention is shown. FIG. 1 is a sectional view of an ink jet recording head, and FIG. 3A is a top side perspective view of the ink jet recording head, and FIG. 3B is a bottom side perspective view of the ink jet recording head.

Referring to FIG. 1, the entire structure of the ink jet recording head of this embodiment will be described. It comprises an energy base plate (heater board constituting recording elements) 2 and a flexible wiring board (wiring member) 3. The heater board 2 is made mainly of Si or the like and has on its surface a heat generating portion (heaters) of electrothermal transducers for producing thermal energy for ejecting the ink. The flexible wiring board 3 is made of polyimide or polyester resin and has electric contacts (contact pads) 4 for transmitting electric signals from the main assembly of the recording apparatus to the heater board 2. The heater board 2 and the wiring board 3 are on the supporting member 1 made of aluminum or the like. The heater board 2 and the wiring board 3 are electrically connected by wire bonding 7.

Between the supporting member 1 and the flexible wiring member 3 and at the backside of the connecting portion of the wire bonding, there is a first reinforcing plate 301 made of glass and epoxy resin or the like, which is bonded. The flexible portion of the flexible wiring member 3 without the reinforcing plate, is bent by approx. 180 degrees in this embodiment. A second reinforcing plate 302 of glass or epoxy resin material is bonded to the flexible wiring member 3 corresponding to the contact pads 4 at the backside of the supporting member 1. The contact pads 4 of the flexible wiring member 3 are contacted to contact pads of a flexible wiring member of the main assembly of the recording apparatus, so that the electric signals are transmitted from the recording apparatus side to the recording element side.

The ink is supplied from the main assembly of the recording apparatus through an ink supply port 6*a* of an ink supply member 6 to the inside of the top plate 5 constituting the common chamber and the ink passage wall, and is heated by the heaters on the heater board 2, so that the ink is ejected through ejection outlets 8.

The description will be made as to the major parts of the recording head manufacturing. An adhesive such as epoxy resin adhesive or silicone resin adhesive SE9145, SE4410 (available from Toray Dow Corning Silicon Co.), is applied through screen printing or the like on a necessary part on a surface of a supporting member which has been cleaned. The supporting member may be made of ceramic or glass material or the like. However, it is preferable to use metal such as aluminum or the like.

Then, a heater board 2 having the recording elements is positioned and bonded to an end portion of the surface coated with the adhesive, and a part of the wiring member 3 of polyimide or polyester material is positioned using a positioning member (not shown) and is bonded on the other end portion of the same surface of the supporting member so that the portion thereof having the contact pads effective to establish electric connection with the main assembly, overhangs beyond the supporting member.

Thereafter, the connecting portion between the heater board 2 and the wiring member 3, are connected by wire bonding. By bonding the top plate on the heater board, an ink passage or common liquid chamber is formed to provide recording elements. An ink supply member 6 is connected to the top plate, and the sealing is effected using silicone resin sealing material or the like.

The overhung portion having the contact pads is folded by 180 degrees, and the folded portion is bonded to the backside of the supporting member or plate 1.

FIG. 3B, reference numeral 9 is a positioning hole for positioning the wiring board 3 to be folded and bonded. The supporting plate 1 is provided with a corresponding positioning hole or recess at a proper position. By alignment of the holes, the correct positioning is established. However, the positioning may be effected without using the opening of the wiring board 3. It is possible to do so using the shape of the wiring board and the supporting plate (proper engagement relation, for example). The same positioning is desirable in the connection between the wiring board 3 and the heater board 2.

Since the contact pad is disposed opposite from a side having the heater board 2, both of the surfaces of the supporting plate 1 are used efficiently. In addition, the area of the supporting plate 1 can be reduced, thus permitting a reduction in size of the recording head. Also, the contact pads are disposed opposite from the ink joint portion, so contamination of the contact pads with ink can be avoided, and the influence to the electric connection can be also avoided.

EMBODIMENT 2

In the foregoing embodiment 1, wiring bonding was used for the connection between the heater board 2 and the flexible wiring board 3. Another connecting system is also usable.

Figure 2:
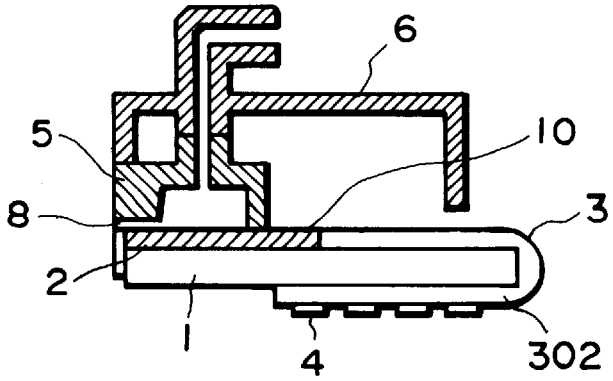
FIG. 2 is a sectional view of an ink jet recording head according to another embodiment of the present invention.

In FIG. 2 embodiment, the heater board 2 and the flexible wiring member 3 are connected, using TAB. In this embodiment, the area required by the connection can be further reduced, as compared with the wire bonding method, and therefore, the area of the supporting plate can be further reduced. Then, the size of the ink jet recording head can be further reduced.

In the embodiment of FIGS. 1–3, the flexible wiring member 3 is folded by approx. 180 degrees. However, the angle is not limited to 180 degrees.

Figure 4:
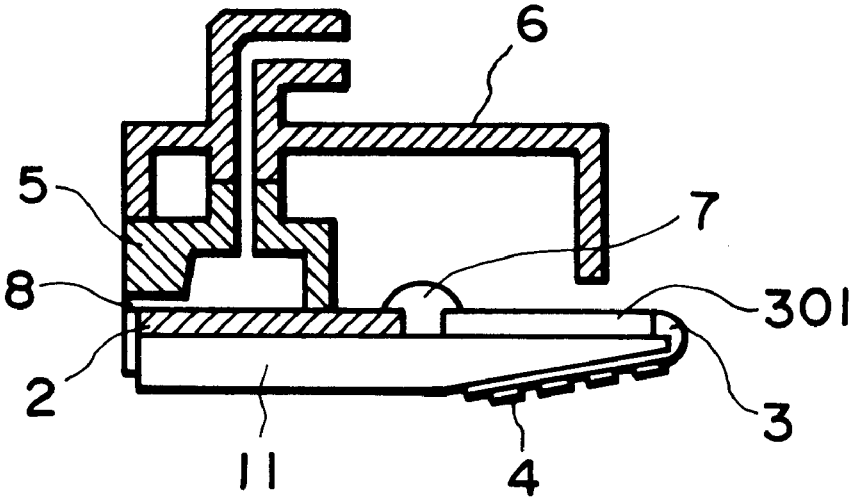
FIG. 4 is a sectional view of an ink jet recording head according to a further embodiment of the present invention.

In FIG. 4, a supporting plate 11 for supporting the heater board 2 and the flexible wiring member 3 is made of molded material or the like which can be freely designed in the configuration.

In this embodiment, the folding angle is between 90–180 degrees since the angle is smaller than that in the foregoing embodiment, and therefore, the stress in the bent portion of the flexible wiring member 3 is smaller with the result of higher reliability. In addition, this allows latitude in the design relating to the position of the contact pads and the folding angle.

EMBODIMENT 4

Figure 5:
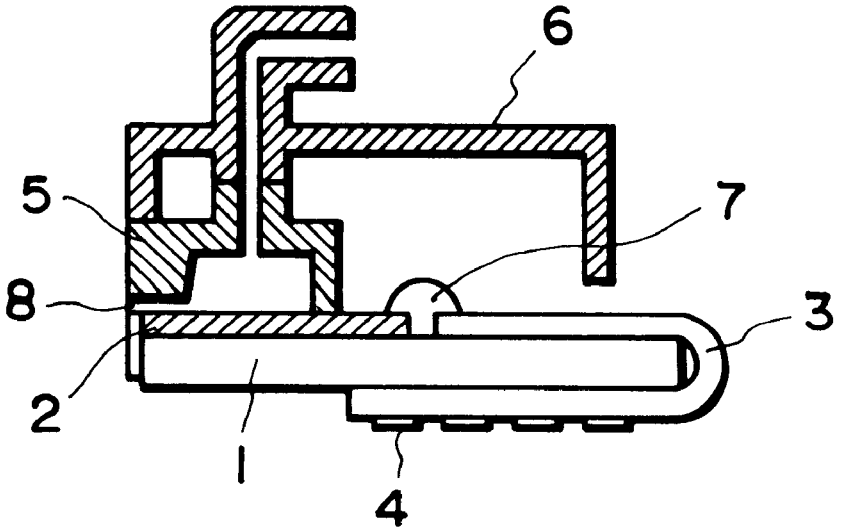
FIG. 5 is a sectional view of an ink jet recording head depicting still another embodiment of this invention.

Referring to FIG. 5, there is shown a further embodiment, in which a heater board 2 made mainly of Si and having a surface electrothermal transducer element layer (energy generating element) for generating energy used for ejection of an ink, is disposed on a part of a supporting plate 1 made of metal such as aluminum or the like. The wiring member 3 made mainly of aluminum is effective to transmit electric signals from the main assembly of the recording apparatus to the heater board 2. It comprises a connecting portion for connection with the heater board 2 and contact pads 4 for connection with the recording apparatus. The connecting portion is disposed on the same surface of the supporting plate 1 as that having the heater board 2. The contact pads 4 are disposed on the opposite side of the supporting plate. The heater board 2 and the wiring member 3, are connected by wire bonding.

The other structure of the recording head and the manufacturing steps of the recording head, are the same as in the foregoing embodiments, and therefore, the detailed description thereof omitted for simplicity.

The base material of the wiring member 3 may be any metal (including alloy) if it can be bent by not less than 90 degrees. Preferably, it is metal such as aluminum or copper. There is a liability that the wiring member of metal is cracked with the result of disconnection in the wiring, if it is bent with a radius not more than approx. 2.5 times the thickness of the wiring member. Therefore, the wire is preferably as thin as possible from the standpoint of folding. However, from the standpoint of configuration maintenance and the flatness of the contact surface, a certain degree of thickness is required.

The preferable range of thickness in this embodiment is 0.1–0.5 mm.

As described in this embodiment, by bending he metal wiring member, the contact pads are disposed on a surface opposite from the heater board 2, and therefore, the surfaces of the supporting plate 1 can be efficiently used. In addition, the area of the supporting plate 1 can be reduced so that the size of the recording head can be reduced.

Since the contact pads are disposed on the opposite side of the ink joint portion, contamination of the contact pads with the ink can be prevented.

Since the basic material of the wiring member is metal, static electricity from human body or the like which is transferred, upon the mounting or exchanging of the ink jet recording head, is discharged through the metal portion of the wiring member to the ground, and therefore, it is not discharged to the heater board, thus preventing damage of the ink jet recording head due to the static electricity.

Since the wiring member is made of metal, the heat can be transmitted to the apparatus through the contact portion, and when the recording head and the ink container are joined, the heat can be transferred to the cartridge, so that a uniform temperature can be provided in the neighborhood of the recording head.

EMBODIMENT 5

Figure 6:
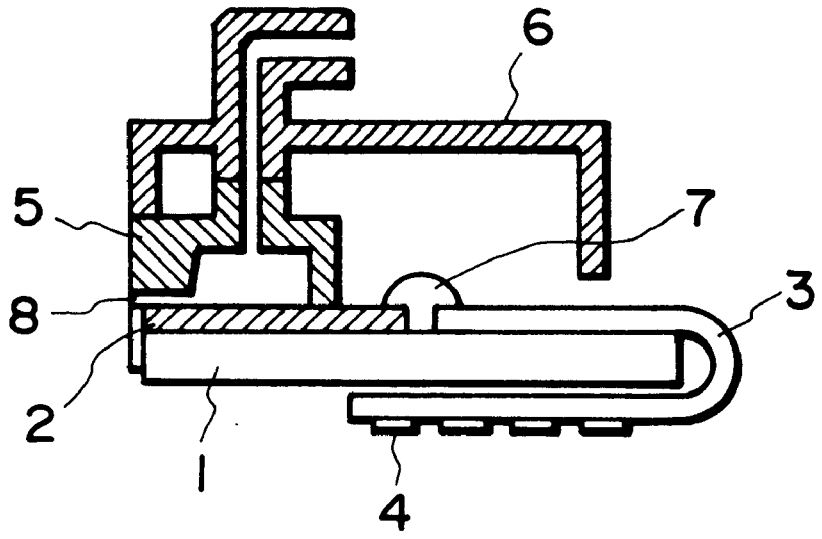
FIG. 6 is a sectional view illustrating yet another embodiment of this invention.

FIG. 6 shows another embodiment. In the foregoing fourth embodiment, the wiring member 3 of metal is bonded to the backside of the supporting member 1. In the embodiment shown in FIG. 6, it is not bonded to the backside, but is slightly spaced from the backside of the supporting member 1, using the property of the metal material.

Upon contact between the main assembly of the apparatus and the contact pads of the flexible wiring board, this clearance provides a cushion effect, and the reliability of the electric connection is increased.

Even if there is a clearance, it can be properly supported by bonding a part because of the use of the metal, and therefore, there is no need of bonding onto the backside. This is effective to omit the bonding process in the manufacturing, and the manufacturing becomes easier.

EMBODIMENT 6

In the foregoing embodiments, the arrangement, on the supporting member, of the element board having the energy generating means for ink ejection and the wiring board. More particularly, the contact pads are disposed on the side opposite from the side of the supporting plate having the element board.

In this embodiment, by further improving the folding of the wiring member and the wiring, the electric connection between the element board and the apparatus can be made more reliable.

The structure and the manufacturing method in this embodiment are the same except for as described in the following. In this embodiment, as shown in FIGS. 7, 8A, 8B and 8C, an end of the supporting member corresponding to the wiring member folding region, is formed with a fold supporting portion 1*a* having the form of a curve (i.e., semi-circular). Along the curved surface, the wiring board is bent.

Because of the folding portion supporting end, the wiring member can be smoothly folded, and in addition, the contact pads can be correctly positioned to the predetermined positions on the supporting member with stability.

Because of the provision of the folding portion supporting end, the wiring member is prevented from being bent too sharply, and therefore, the possibility of the damage to the wiring in the folding region, can be reduced.

Figure 8A:
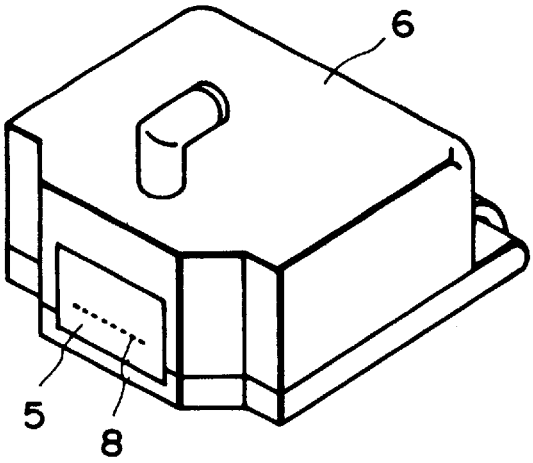
FIGS. 8A, 8B and 8C are bottom, top and bottom perspective views of the ink jet recording head according to an embodiment of the present invention.
Figure 8B:
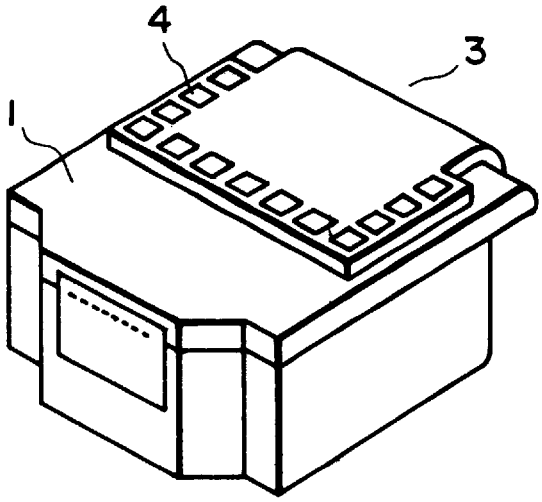
Figure 8C:
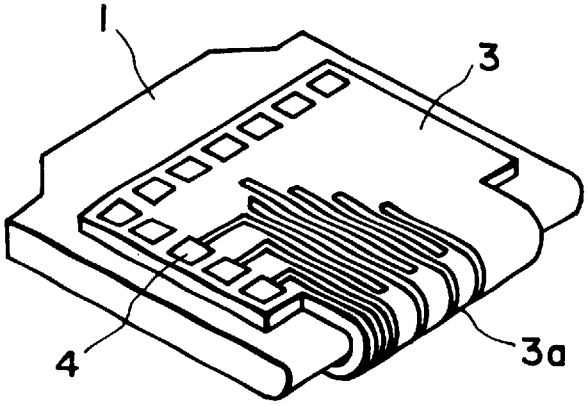
Figure 9:
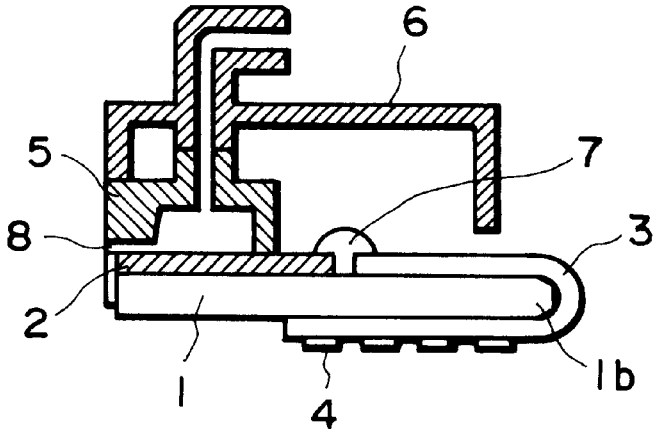
FIG. 9 is a sectional view of an ink jet recording apparatus according to a further embodiment of the present invention.

When the wiring pattern in the region where the wiring board is bent, is parallel with the folding direction, as shown in FIG. 8C, the possibility of damage to the wiring is reduced.

EMBODIMENT 7

In the foregoing embodiment, the folding portion supporting end of the supporting member 1 is in the form of a round surface. In another embodiment, the end configuration has two or more appex lines (1*b*) to assist proper bending of the wiring member 3.

The same advantageous effects as in the previous embodiment, can be obtained. However, the present embodiment is advantageous in that the formation of the folding portion supporting portion is easy since it is only necessary to cut the surfaces.

In the foregoing embodiments, the recording head is of a type in which ink droplets are ejected by creating a bubble in the ink by thermal energy. The present invention, however, is also applicable to another type of recording head in which the ink droplets are ejected with the use of piezoelectric elements or the like.

EMBODIMENT 8

Figure 10:
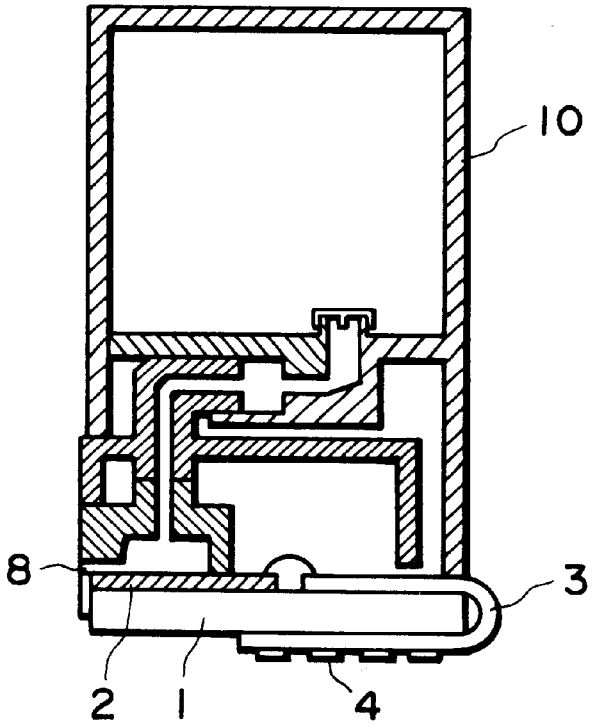
FIG. 10 is a sectional view of an ink jet recording head cartridge according to a further embodiment of the present invention.

FIG. 10 shows a further embodiment in which the ink jet recording head and a detachably mountable ink container 10, are connected. As described in the foregoing embodiment, since the size of the recording head can be reduced, the size of the ink container can be reduced. Where a metal member is used as the wiring member, and the ink container can contain the ink above the wiring board, the heat can be transmitted to the ink container from the recording head through the wiring member.

Figure 11:
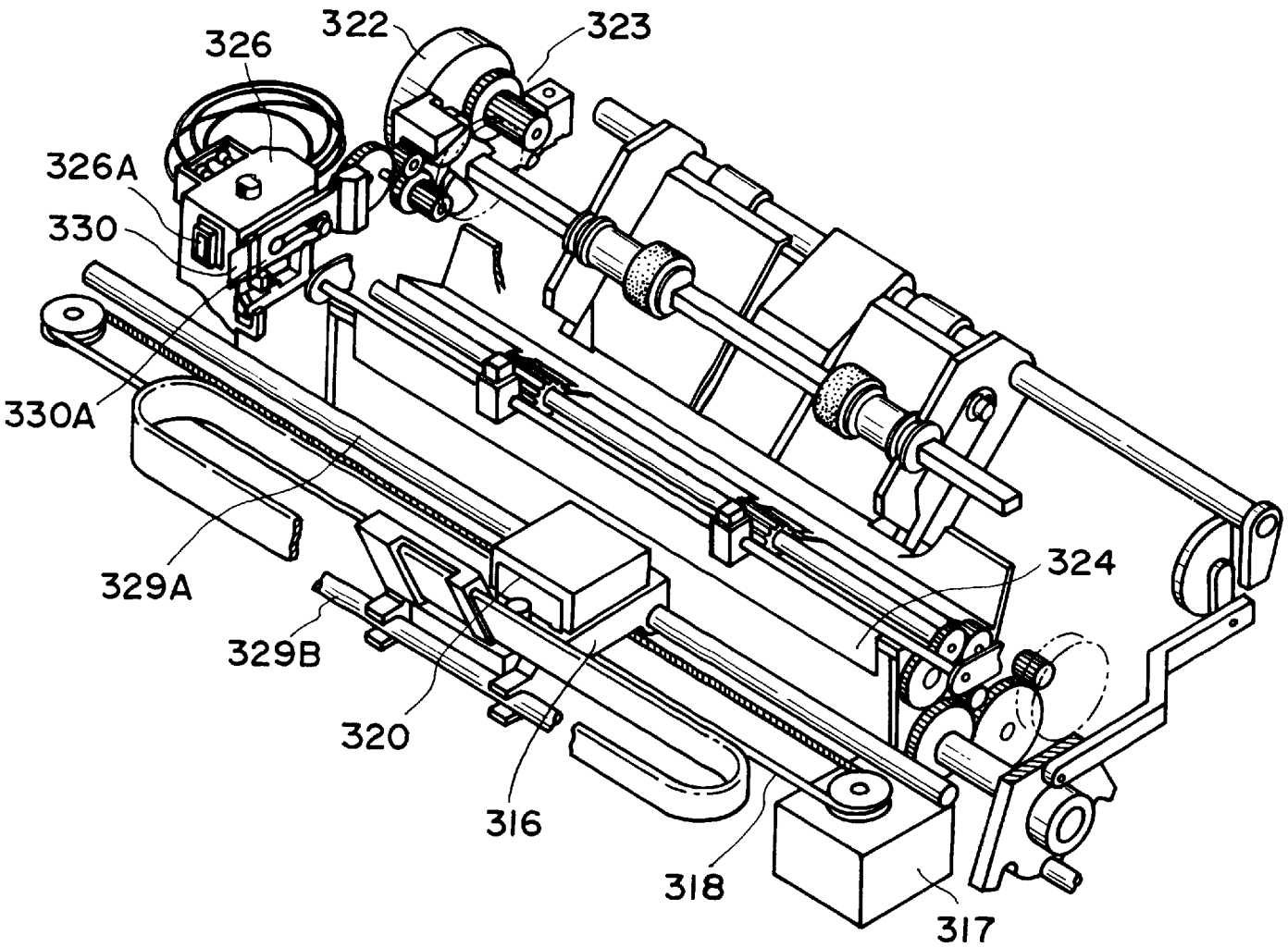
FIG. 11 is a perspective view of a major part of an example of an ink jet recording apparatus according to an embodiment of the present invention.

Referring to FIG. 11, the description will be made as to an ink jet recording apparatus loaded with an ink jet recording head and an ink jet recording head cartridge in accordance with the embodiments of the present invention. FIG. 11 is a schematic perspective view illustrating a major part of the example of the ink jet recording apparatus.

In FIG. 11 an ink jet recording head cartridge 320 is a cartridge type having an integral ink container and detachably mountable to an ink jet recording apparatus. It comprises a plurality of ink ejection outlets facing a recording surface of a recording material (not shown) on a platen 324. A carriage 316 for carrying the ink jet recording head cartridge 320 is operatively coupled with a part of a driving belt 318 for transmitting driving force from a driving motor 317. The carriage 316 is slidingly guided on two guiding shafts 329A and 329B. Thus, the ink jet recording head cartridge 320 is reciprocable over the entire width of the recording material.

A recovery device 326 functions to prevent, and recover from, improper ink ejection from the recording head, and is disposed at a position faced to a predetermined position within a movable range of the ink jet recording head cartridge 320, home position, for example. The recovery device 326 caps ejection outlets of the ink jet recording head by the driving force from the motor 322 through the transmission mechanism 323. In interrelation with the capping operation for the ejection outlets of the ink jet recording head by the cap 326A of the recovery device 326, the ink is sucked through the ejection outlets by suitable sucking means (not shown) in the recovery device 326, or the ink is pressurized by suitable pressurizing means (not shown) provided in an ink supply passage to the ink jet recording head where the ink is supplied from the apparatus to the recording head. By doing so, the ink is forcedly ejected through the ejection outlets to remove foreign matter such as high viscosity ink or the like in the ejection outlets. A blade 330 is disposed to a side of the recovery apparatus 326 and is made of silicone rubber. It functions as a wiping member and is cantilevered on a blade supporting member 330A. Similarly to the recovery device 326, it is operated by the motor 322 and the transmission mechanism 323 to be contacted to the ejection outlet side surface of the ink jet recording head. At proper timing during recording operation of the ink jet recording head, after recovery operation of the recovery device 326, the blade 330 is projected into the movable range of the ink jet recording head, and together with the movement of the ink jet recording head, the moisture, wet or foreign matter can be removed from the ejection side surface.

The recording sheet feeding means, the carriage, the recovery device, the recording head or the like movements in the ink jet recording head, are controlled on the basis of instructions and signals produced from control means including CPU, for example, of the main assembly of the apparatus.

The description will be made as to an information processing apparatus having recording apparatus, particularly the electric circuits therefor.

Figure 12:
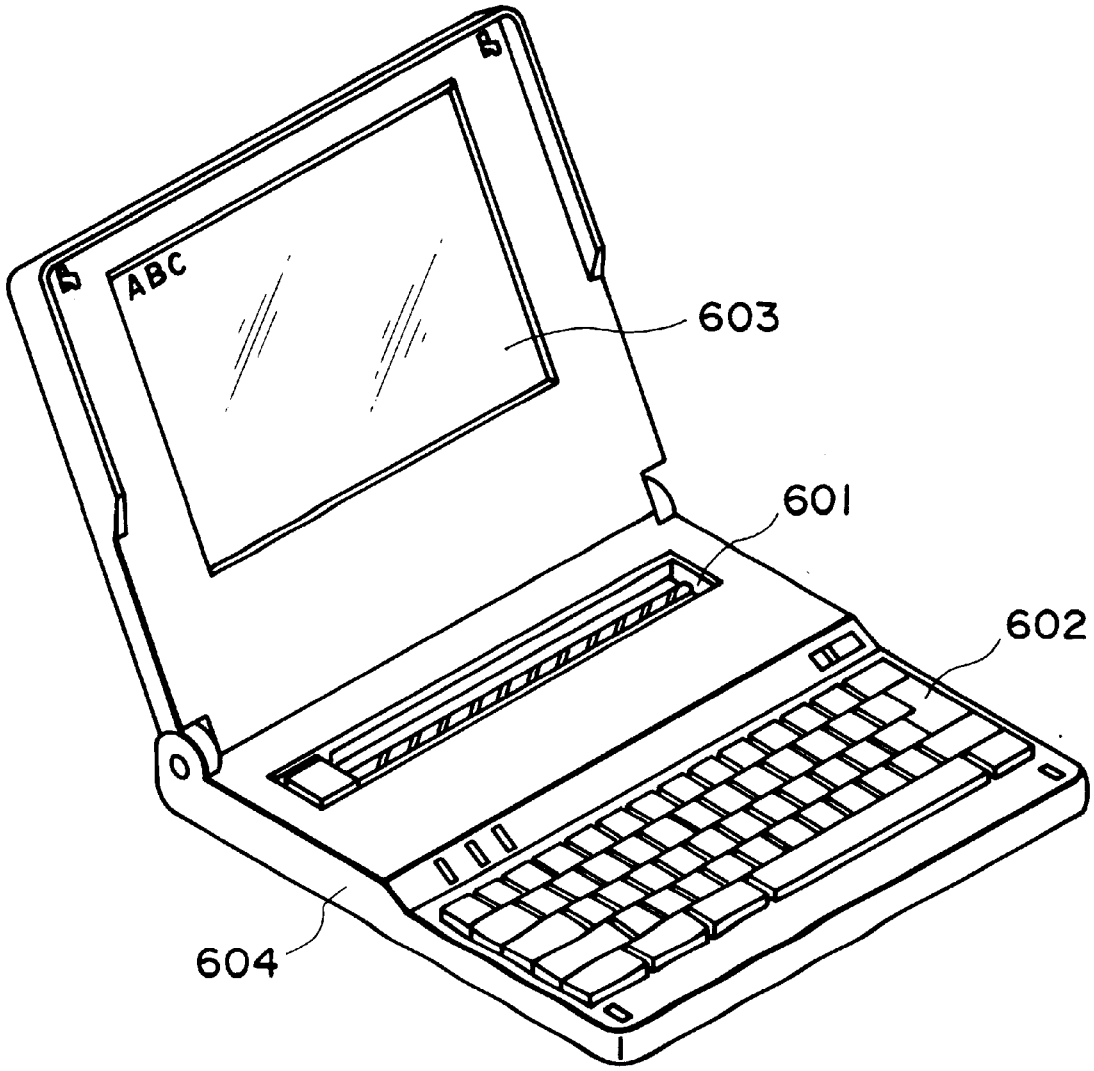
FIG. 12 is a perspective view of an information processing apparatus according to an embodiment of the present invention.

FIG. 12 is a perspective view of the outside of the information processing apparatus 604 incorporating the recording apparatus of this invention. It comprises a printer portion 601, a keyboard portion 602 provided with keys for inputting characters, numericals and the like and keys for various instructions, and display portion 603 provided with a display device.

Figure 13:
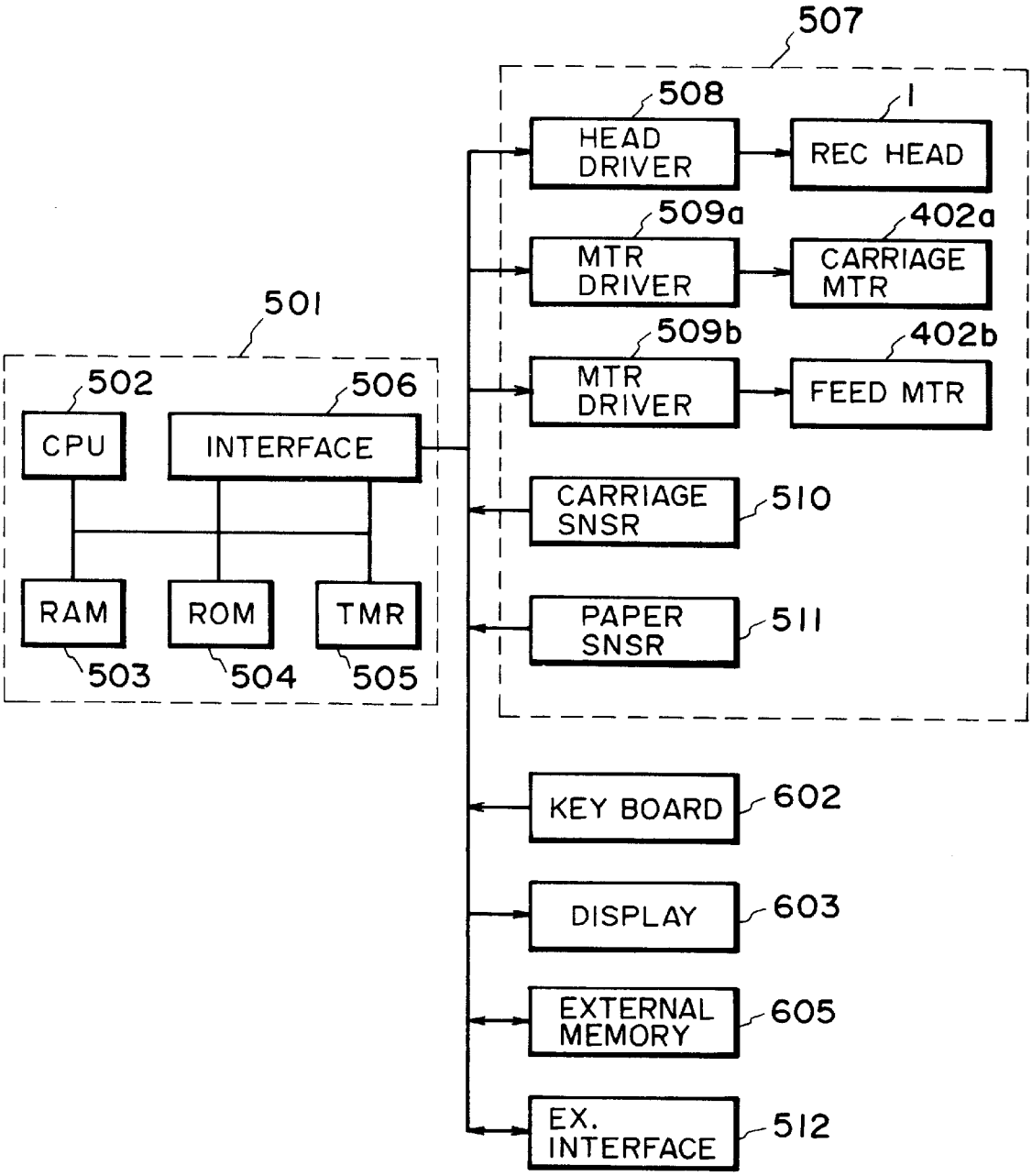
FIG. 13 is a block diagram of a major part of an electrical circuit of the information processing apparatus having the recording apparatus of this invention.
Figure 14:
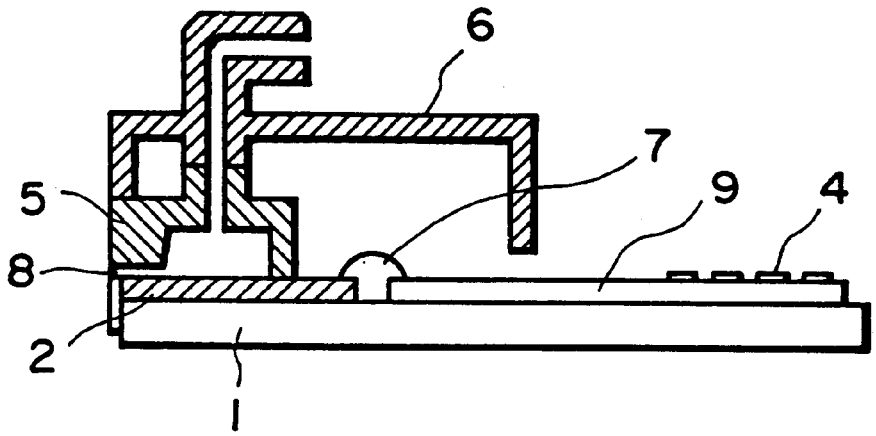
FIG. 14 PRIOR ART
FIG. 14 is a sectional view of an ink jet recording head not using the present invention.
Figure 15:
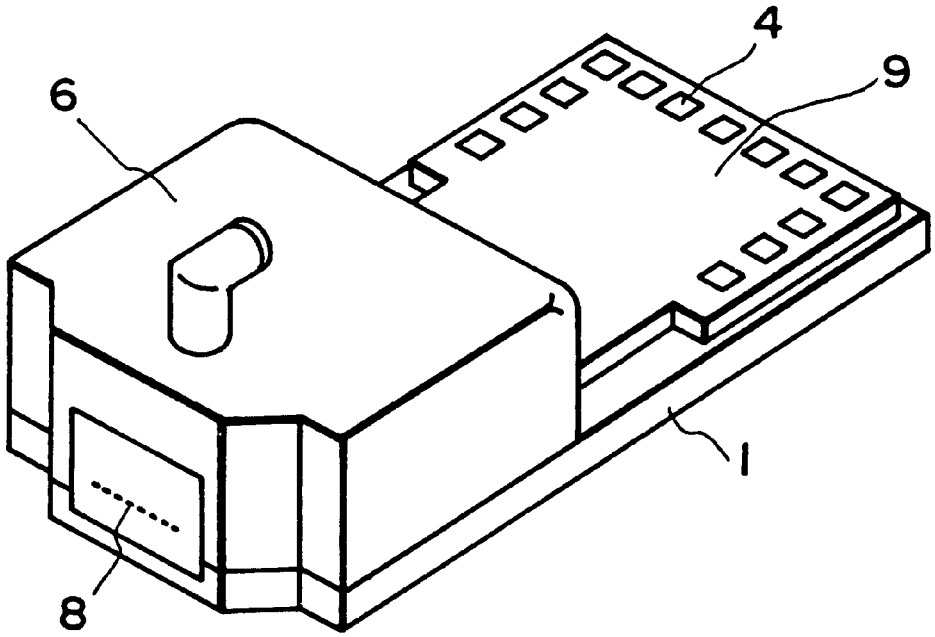
FIG. 15 PRIOR ART
FIG. 15 is a perspective view of an ink jet recording head not using the present invention.

FIG. 13 is a block diagram of the electric circuit of the information processing apparatus. As shown in this Figure, the electric circuit comprises a main controller 501, a CPU in the form of a microcomputer, for example, for executing programmed steps, RAM 503 containing an area for developing text data or image data and a working area, ROM 504 for storing program corresponding to the steps, font data or other fixed data, a timer 505 for producing executing cycle of the CPU 502 and for producing proper timing for the recording operation of the printer 601, and an interface 506 for supplying the signal from CPU 502 to the peripheral devices.

It further comprises a printer 601 controller 507, a head driver 508 for supplying the record signals or the electric power to the head cartridge 101, motor drivers 509*a* and 509*b* for supplying necessary signals and the electric power for the drive of the carrier motor 402*a* and the feeding motor 402*b*, respectively, a carriage sensor 510 for detecting the position of the carriage 102 and for discriminating whether the carriage 102 is at the home position or not, a paper sensor 511 for detecting presence or absence of recording material to prevent the recording outside the recording material 6 when the recording material 6 is not properly set or when the record has already reached the end of the page.

Designated by a reference numeral 605 is an external memory device in the form of FDD, HDD, RAM card or the like. A reference numeral 512 designates an external interface for communication with another information processing apparatus or for controlling peripheral machines by direct connection via an internal bus.

Figure 7:
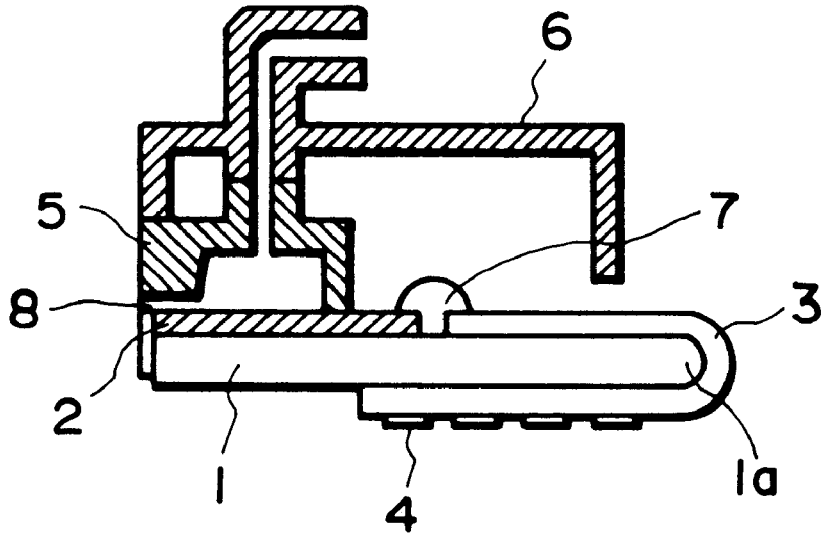
FIG. 7 is a sectional view according to an embodiment of the present invention.

Although not shown in the block diagram of FIG. 7, there is provided a power source for supplying the electric power to the electric circuit. It may be in the form of a chargeable battery, disposable battery or AC voltage converter.

The present invention is particularly suitably usable in an ink jet recording head and recording apparatus wherein thermal energy generated by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed in a liquid (ink) retaining sheet or liquid passage, the driving signal being enough to provide such a quick temperature rise beyond a departure from nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as is disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the types of the recording heads mountable, they may be a single head corresponding to a single color ink, or may be plural heads corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material.

The ink jet recording apparatus may be used as an output terminal of an information processing apparatus such as computer or the like, as a copying apparatus combined with an image reader or the like, or as a facsimile machine having information sending and receiving functions.

As described in the foregoing, since the contact pads and the heater board are disposed on different surfaces, and therefore, surfaces of a supporting plate can be efficiently used, and the area of the supporting plate can be reduced, thus permitting reduction of the recording head size.

Since the contact pads are disposed on the side opposite from the ink joint portion, the contact pads are protected from contamination with the ink.

By the use of the metal for the basic material of the wiring member, the static electricity from the human body or the like can be discharged to the ground through the metal portion of the wiring member when the ink jet recording head is mounted or exchanged. Therefore, the electricity does not flow into the heater board, thus preventing damage of the ink jet recording head by the static electricity. By spacing the contact pad portion of the metal wiring board from the supporting member with a small clearance, the cushion effects are provided upon the contact between the contact pads of the flexible wiring board and the main assembly of the apparatus, thus increasing the connection reliability. In this case, the bonding process can be avoided.

In an aspect of the present invention, since an end of a supporting member corresponding to the folding portion of the wiring board is formed into folding portion, supporting portion, or since the wiring pattern is generally parallel with the bending direction, and therefore, the contact pads can be disposed on the side opposite from the side having the heater board, without damage such as wire disconnection. In addition, the wiring disconnection during use can be prevented. By closely bonding it to the backside of the supporting member 1, the positioning of the contact pads relative to the supporting plate l, can be stabilized.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head cartridge, comprising:

an ink container;

an ink jet recording head which ejects an ink through an ejection outlet for effecting recording, said recording head including:

a supporting member having a given surface and an opposite surface opposite from said given surface, and having a given edge and an opposite edge opposite from said given edge, a recording element disposed on said given surface, said recording element having an energy generating means for applying energy to the ink so that the ink is ejected in accordance with a record signal, and an ink passage disposed on said recording element and corresponding to said energy generating means;

an ink supply member for connection with said ink container, said ink supply member having an ink supply port at a position which is more remote from said opposite surface than from said given surface of said supporting member;

a wiring member including:

a folded portion folded at said given edge of said supporting member, a first electric connection part, disposed on said given surface, and connected to said recording element, and a second electric connection part connectable to an outside of said recording head to transmit the record signal to said recording element, wherein said second electric connection part is disposed on said opposite surface of said supporting member, and said ink container is connected to said ink supply member of said ink jet recording head to supply the ink to said recording head, and said ink container is disposed above said given surface of said supporting member and said election outlet is disposed in a vicinity of said opposite edge of said supporting member.

2. An ink jet recording apparatus, comprising:

an ink jet head cartridge comprising;

an ink container, an ink jet recording head which ejects an ink through an ejection outlet for effecting recording, said recording head including, a supporting member having a given surface and an opposite surface opposite from said given surface, and having a given edge and an opposite edge opposite from said given edge, a recording element disposed on said given surface, said recording element having an energy generating means for applying energy to the ink so that the ink is ejected in accordance with a record signal, and an ink passage disposed on said recording element and corresponding to said energy generating means, an ink supply member for connection with said ink container, said ink supply member having an ink supply port at a position which is more remote from said opposite surface than from said given surface of said supporting member, a wiring member including:

a folded portion folded at said given edge of said supporting member, a first electric connection part, disposed on said given surface, and connected to said recording element, and a second electric connection part connectable to an outside of said recording head to transmit the record signal to said recording element, wherein said second electric connection part is disposed on said opposite surface of said supporting member, and said ink container is connected to said ink supply member of said ink jet recording head to supply the ink to said recording head, and said container is disposed above said given surface of said supporting member; and carrying means for carrying said ink jet recording head and at least one said electric connection part of said ink jet recording head and said ejection outlet, said carrying means being disposed in a vicinity of said opposite edge of said supporting member.

3. The apparatus according to claim 2, wherein said wiring member comprises a metal member as a base member thereof.

4. An apparatus according to claim 3 or 2, wherein said energy generating means comprises an electrothermal transducer for producing thermal energy.

5. A cartridge according to claim 1, wherein said wiring member comprises a metal member serving as a base member.

6. The ink jet head cartridge according to claim 1 or 5, wherein said energy generating means comprises an electrothermal transducer for producing thermal energy.

7. The cartridge according to claim 1 or 5, wherein said ink jet recording head and said ink container are separable.

8. The cartridge according to claim 7, wherein said ink container contains the ink.

9. The cartridge according to claim 1, wherein said ink container contains the ink.

10. The ink jet head cartridge according to claim 1, wherein said first electric connection part and said recording element are connected by wire bonding.

11. An ink jet recording head which ejects an ink through an ejection outlet for effecting recording, comprising:

a supporting member having a given surface and an opposite surface opposite from said given surface, and having a given edge and an opposite edge opposite from said given edge;

a recording element disposed on said given surface, said recording element having an energy generating means for applying energy to the ink so that the ink is ejected in accordance with a record signal;

an ink passage disposed on said recording element and corresponding to said energy generating means;

an ink supply member for connection with an ink container, said ink supply member having an ink supply port at a position which is more remote from said opposite surface than from said given surface of said supporting member;

a wiring member including:

a folded portion folded at said given edge of said supporting member, a first electric connection part, disposed on said given surface, and connected to said recording element, and a second electric connection part connectable to an outside of said recording head to transmit the record signal to said recording element, wherein said second electric connection part is disposed on said opposite surface of said supporting member and said election outlet is disposed in a vicinity of said opposite edge of said supporting member.

12. An ink jet recording apparatus comprising:

an ink jet head cartridge comprising:

an ink container;

an ink jet recording head which ejects an ink, through an ejection outlet for effecting recording, said recording head including:

a supporting member having a given surface and an opposite surface opposite from said given surface, and having a given edge and an opposite edge opposite from said given edge, a recording element disposed on said given surface, said recording element having an energy generating means for applying energy to the ink so that the ink is ejected in accordance with a record signal, and an ink passage disposed on said recording element and corresponding to said energy generating means;

an ink supply member for connection with said ink container, said ink supply member having an ink supply port at a position which is more remote from said opposite surface than from said given surface of said supporting member;

a wiring member including:

a folded portion folded in a folding direction, the folded portion having a wiring pattern, and an edge part of said supporting member corresponds to the folded portion, a first electric connection part, disposed on said given surface, and connected to said recording element, and a second electric connection part connectable to an outside of said recording head to transmit the record signal to said recording element, wherein said second electric connection part is disposed on said opposite surface of said supporting member, and said ink container is connected to said ink supply member of said ink jet recording head to supply the ink to said recording head, and said container is disposed above said given surface of said supporting member ; and carrying means for carrying said ink jet recording head and at least one said electric connection part of said ink jet recording head and said ejection outlet, said carrying means being disposed in a vicinity of said opposite edge of said supporting member.

13. The ink jet recording apparatus according to claim 12, wherein said wiring member comprises a metal member serving as a base member.

14. The ink jet recording apparatus according to claim 12 or 13, wherein said energy generating means comprises an electrothermal transducer for producing thermal energy.

15. The inkjet recording apparatus according to claim 12 or 13, wherein said ink jet recording head and said ink container are separable.

16. The inkjet recording apparatus according to claim 15, wherein said ink container contains the ink.

17. The cartridge according to claim 12, wherein said ink container contains the ink.

18. The ink jet recording apparatus according to claim 12, wherein said first electric connection part and said recording element are connected by wire bonding.

* * * * *

UNITED STATES PATENT AND TRADEMARK OFFICE

CERTIFICATE OF CORRECTION

PATENT NO. : 6,328,422 B1
DATED : December 11, 2001
INVENTOR(S) : Kenjiro Watanabe et al.

It is certified that error appears in the above-identified patent and that said Letters Patent is hereby corrected as shown below:

Title page,
Item [56], U.S. PATENT DOCUMENTS,
"4,558,333" 12/1985 Suqitani et al." should read -- 4,558,333 12/1985 Sugitani et al. --.

Column 2,
Line 64, "present:" should read -- present --.

Column 5,
Line 4, "shape" should read -- shapes --.

Column 6,
Line 14, "he" should read -- the --; and
Line 57, "board." should read -- board, is described. --.

Column 8,
Line 3, "faced to" should read -- facing --.

Column 9,
Line 3, "the" (first occurrence) should be deleted; and
Line 32, "from" should read -- from the --.

Column 10,
Line 33, "is the" should read -- in the --.

Column 11,
Line 55, "election" should read -- ejection --.

Column 12,
Line 37, "claim 3 or 2," should read -- claim 2 or 3, --.

Column 13,
Line 17, "election" should read -- ejection --.

UNITED STATES PATENT AND TRADEMARK OFFICE

CERTIFICATE OF CORRECTION

PATENT NO. : 6,328,422 B1
DATED : December 11, 2001
INVENTOR(S) : Kenjiro Watanabe et al.

It is certified that error appears in the above-identified patent and that said Letters Patent is hereby corrected as shown below:

Column 14,
Line 17, "member ;" should read -- member; --; and
Line 35, "cartridge" should read -- ink jet recording apparatus --.

Signed and Sealed this

Fifth Day of August, 2003

JAMES E. ROGAN
*Director of the United States Patent and Trademark Office*